US006510587B2

(12) United States Patent
Urschel et al.

(10) Patent No.: US 6,510,587 B2
(45) Date of Patent: Jan. 28, 2003

(54) DOOR CLOSURE PREVENTION APPARATUS AND METHOD

(75) Inventors: Ned R. Urschel, Lexington, KY (US); Wilbur Bewley, Nicholasville, KY (US); Gary Murphree, Annandale, VA (US)

(73) Assignee: Sargent & Greenleaf, Inc., Nicholasville, KY (US)

( * ) Notice: Subject to any disclaimer, the term of this patent is extended or adjusted under 35 U.S.C. 154(b) by 65 days.

(21) Appl. No.: 09/853,696

(22) Filed: May 14, 2001

(65) Prior Publication Data

US 2002/0166203 A1 Nov. 14, 2002

(51) Int. Cl.[7] ..... E05F 5/04

(52) U.S. Cl. ..... 16/83; 16/82; 292/342; 292/DIG. 4

(58) Field of Search ..... 16/82, 83; 292/342, 292/DIG. 4

(56) References Cited

U.S. PATENT DOCUMENTS

| | | | | | |
|---|---|---|---|---|---|
| 646,533 | A | | 4/1900 | Beatty | |
| 759,013 | A | | 5/1904 | Rawlings | |
| 900,621 | A | | 10/1908 | Voight | |
| 1,309,310 | A | * | 7/1919 | Voight | 292/198 |
| 1,493,794 | A | | 5/1924 | Robertson | |
| 1,827,143 | A | * | 10/1931 | Doyle | 16/83 |
| 1,921,568 | A | | 8/1933 | Hasselberger | |
| 2,565,906 | A | | 8/1951 | Berthene | |
| 3,287,050 | A | | 11/1966 | Ferrante | |
| 3,620,483 | A | | 11/1971 | Weinberger | |
| 3,737,186 | A | | 6/1973 | Chezem | |
| 3,800,360 | A | * | 4/1974 | Knarreborg | 16/83 |
| 3,809,419 | A | | 5/1974 | Chezem | |
| 4,261,140 | A | * | 4/1981 | McLean | 16/83 |
| 4,570,984 | A | | 2/1986 | Russ | |
| 5,123,685 | A | | 6/1992 | Donovan | |
| D346,109 | S | | 4/1994 | Comaianni | |
| 5,511,284 | A | * | 4/1996 | Current | 16/49 |
| 6,003,911 | A | * | 12/1999 | Sowash | 16/82 |
| 6,327,743 | B1 | * | 12/2001 | Rashid et al. | 16/82 |

FOREIGN PATENT DOCUMENTS

| | | | | |
|---|---|---|---|---|
| GB | 2058204 A | * | 7/1979 | E05F/3/22 |

* cited by examiner

*Primary Examiner*—Thomas B. Will
*Assistant Examiner*—Alexandra K. Pechhold
(74) *Attorney, Agent, or Firm*—Jacobson Holman PLLC

(57) ABSTRACT

A door closure preventing device is mounted on the inside surface of a door and has a pivotal stop moveable between a deactivated position within the periphery of the door and the extended position extending beyond the periphery of the door to prevent closure of the door. The pivotal stop is moved to its extended position following opening of the door by a user and is then released to move by a spring to an intermediate position projecting beyond the door periphery following which closure of the door results in engagement of the door jamb by the stop to prevent complete closure. Engagement of the stop with the door jamb also returns the stop to is fully extended position and actuates a rotary latch so that upon subsequent opening movement of the door by the user the stop is automatically returned to its fully retracted position to permit a conventional door closure apparatus to fully close the door.

20 Claims, 10 Drawing Sheets

DOOR CLOSURE PREVENTION APPARATUS AND METHOD

BACKGROUND OF THE INVENTION

The subject invention is directed to the field of door blocking devices for preventing a door from moving from an open position to a fully closed position.

Many commercial establishments are provided with doors which permit employees and customers to readily exit from the establishment in case of emergency, such as, fire or other hazards in the establishment. While the front doors of commercial establishments such as retail shops, restaurants and the like are normally maintained in an unlocked condition during business hours, such establishments also frequently have other portals or doors in the rear of the establishment which are maintained in a closed and locked condition and which cannot be opened in a normal manner by persons in the area outside the door. However, it is essential that such doors be capable of being opened from inside the building for use in routine matters, such as, removable of trash. On such occasions, it is frequently desirable to maintain the door in an open non-closed condition for a short time to permit reentry of the user; however, the user frequently has his hands full and cannot manually hold the door in an open position and must spend an inordinate amount of time in effecting blockage of the door.

A wide variety of devices for holding doors in open position have consequently been proposed by those of skill in the art. However, the previously known devices have suffered from a number of shortcomings, such as, being overly complicated and consequently expensive and requiring the user to manually manipulate the closure preventing device in a variety of ways for deactivating the device to permit door closure following return of the user into the building. It is consequently sometimes difficult for a user returning to the building with a cumbersome item, such as, an empty trash container to easily and effective deactivate the door-stopping device while holding the door open against return to its closed position. Other devices require the provision of separate items, such as, brackets, keepers or the like, which must be attached to the door frame or floor for engagement with apparatus attached to the door so as to retain the door in a latched open position. Such devices consequently require substantial labor for installation and maintenance and also in some instances can create a safety hazard.

With respect to the prior art which is directed to devices requiring separate latches or the like attached to the door frame or the floor of the building adjacent to the door which cooperate with door mounted means for maintaining the door in an open position, it should be noted that U.S. Pat. Nos. 646,533; 759,013; 900,621; 1,493,794 and 3,620,483 all relate to devices employing cooperating means attached to the building or floor structure. Similarly, U.S. Pat. DES. 346,109 discloses a door spacer device apparently mounted on a door frame; however, the mechanical structure and operation is not apparent from the disclosure of such patent.

It should also be noted that latch devices for windows, cabinets and the like have been provided with a variety of rotary latch means for holding linear telescopically mounted members in axially adjusted position by use of rotary latches and the like, such as exemplified in U.S. Pat. Nos. 4,042,266; 4,331,355; 4,688,834; 4,709,949; 4,779,906; 4,790,580; 4,932,695 and 5,217,267 all relate to such telescopically mounted latchable devices. Prior art devices requiring separate manual manipulation for disengaging a door stop are exemplified by U.S. Pat. Nos. 1,921,568; 2,565,906; 3,287,050; 3,737,186; 3,809,419, 4,570,984; 4,686,740 and 5,123,685. Other devices such as exemplified by U.S. Pat. Nos. 4,925,072 employ means for latching a closure in position so that it can be reopened by pressure toward the closed position.

Therefore, it is the primary object of the preferred embodiment of the invention to provide a new and improved door blocking device for retaining a door or other closure in a non-closed position.

A further object of the present invention is a provision of a new and improved door blocking device which does not require any manual manipulation of the device for achieving deactivation of the device.

Yet another object of the present invention is the provision of a door blocking device which is deactivated solely by movement of the door toward a more open position from a closure preventing position.

Yet another object of the present invention is the provision of a reliable and economical door blocking device which is initially actuated by the user while opening the door so as to arm the device to preclude full door closure until such time as a further movement of the door toward the open condition is effected.

BRIEF SUMMARY OF THE INVENTION

The preferred embodiment of the subject invention achieves the foregoing objects by the provision of a base member which is attached to an edge portion of the internal surface of an external access providing hinged door of a building. The base member supports a pivotal stop which can pivot between a first or deactivated stop position in which the pivotal stop is positioned within the periphery of the door and a second or extended activated stop position extending beyond the door periphery. The pivoted stop is spring biased towards its first or deactivated position but is prevented from returning to first or deactivated position by rotary latch until such time as the user initiates return to the building. The rotary latch is mounted on the pivotal stop and a series of pivotal movements of the pivotal stop brings the rotary latch into contact with a series of cam surfaces which rotate the rotary latch into a series of positions required during each cycle of operation of the invention.

A cycle of operation begins when a user opens the door and then manually moves the pivotal stop in an opening direction from its first or deactivated position to a second or extended activated position which results in contact of the rotary latch with a first positioning cam surface which rotates the latch into a second position. The user releases the pivotal stop which permits the spring biasing the pivotal stop to move the pivotal stop in a closing direction to an intermediate position in which the rotary latch engages additional positioning cam surfaces which position the latch so that it terminates the closing movement of the pivotal stop. The pivotal stop is consequently held in the intermediate position in which the pivotal stop extends beyond the periphery of the door. The user subsequently releases the door which swings towards its closed position by operation of conventional door closing apparatus. However, the pivotal stop engages the door jamb and prevents full closure of the door with such engagement resulting in pivotal movement of the pivotal stop back to its second or extended position while still preventing fall closure of the door.

The last-mentioned movement of the pivotal stop back to its second or extended position also results in contact of the pivotal stop with positioning cam surfaces in a return enable position where it remains until the user decides to return inside the building and manually opens the door. Opening of the door terminates contact of the pivotal stop with the door frame so that the spring bias effects a rapid return movement of the pivotal stop to its first position in which it is fully within the confines of the door periphery and does not interfere with full door closure being effected by the conventional door closing apparatus when the door is released by the user. During the last-mentioned movement of the pivotal stop, it passes through the intermediate position so that the rotary latch engages positioning cam surfaces which rotate the latch into its final position in which it is properly positioned for the next cycle of operation. It is significant that the user's only contact with the pivotal stop is when he initially moves the stop to its second or extended activated position.

DETAILED DESCRIPTION OF THE INVENTION

Figure 1:
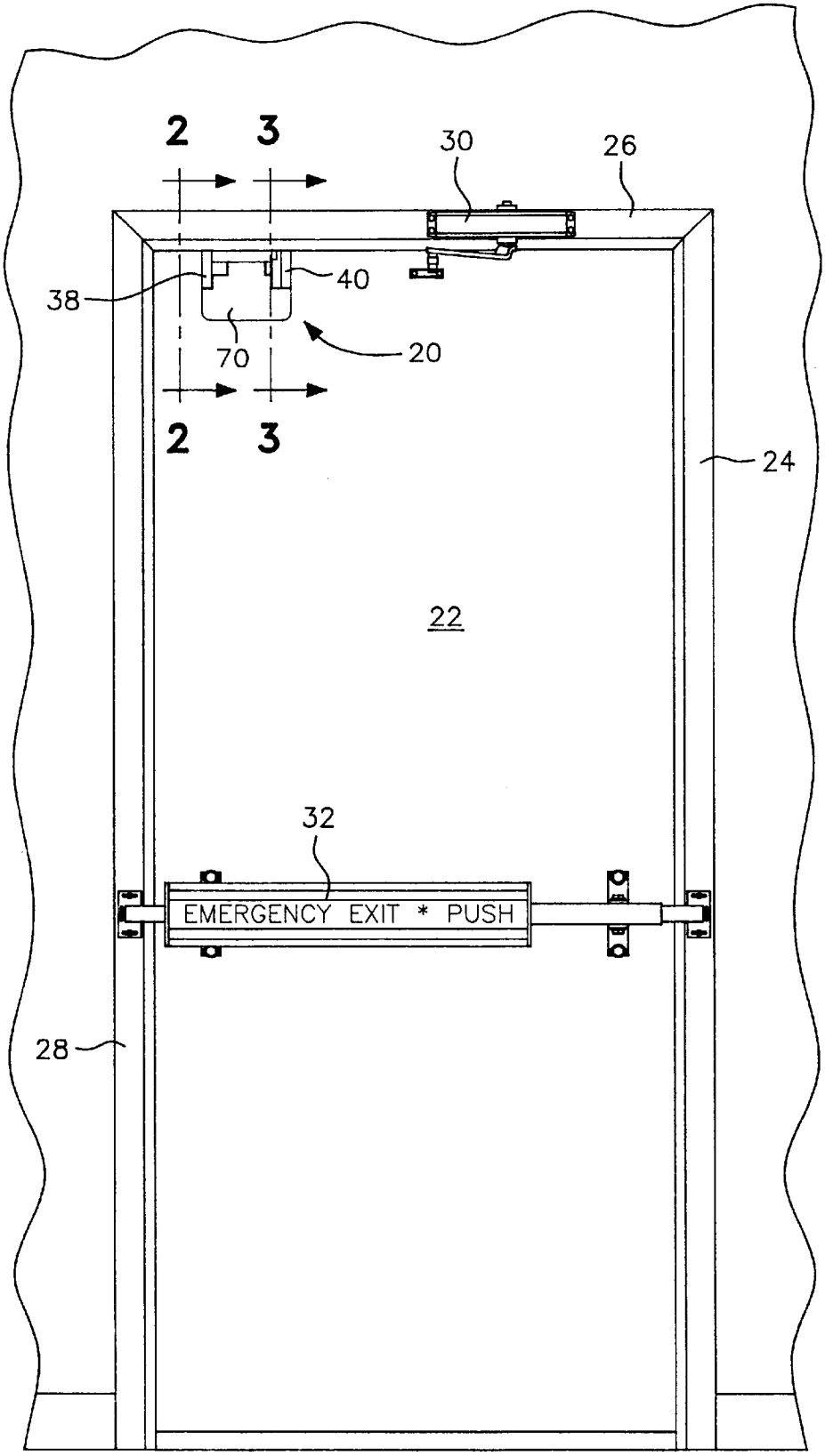
FIG. 1 is a front elevation view from a building interior illustrating the preferred embodiment of the invention mounted on a conventional exterior access door.
Figure 2:
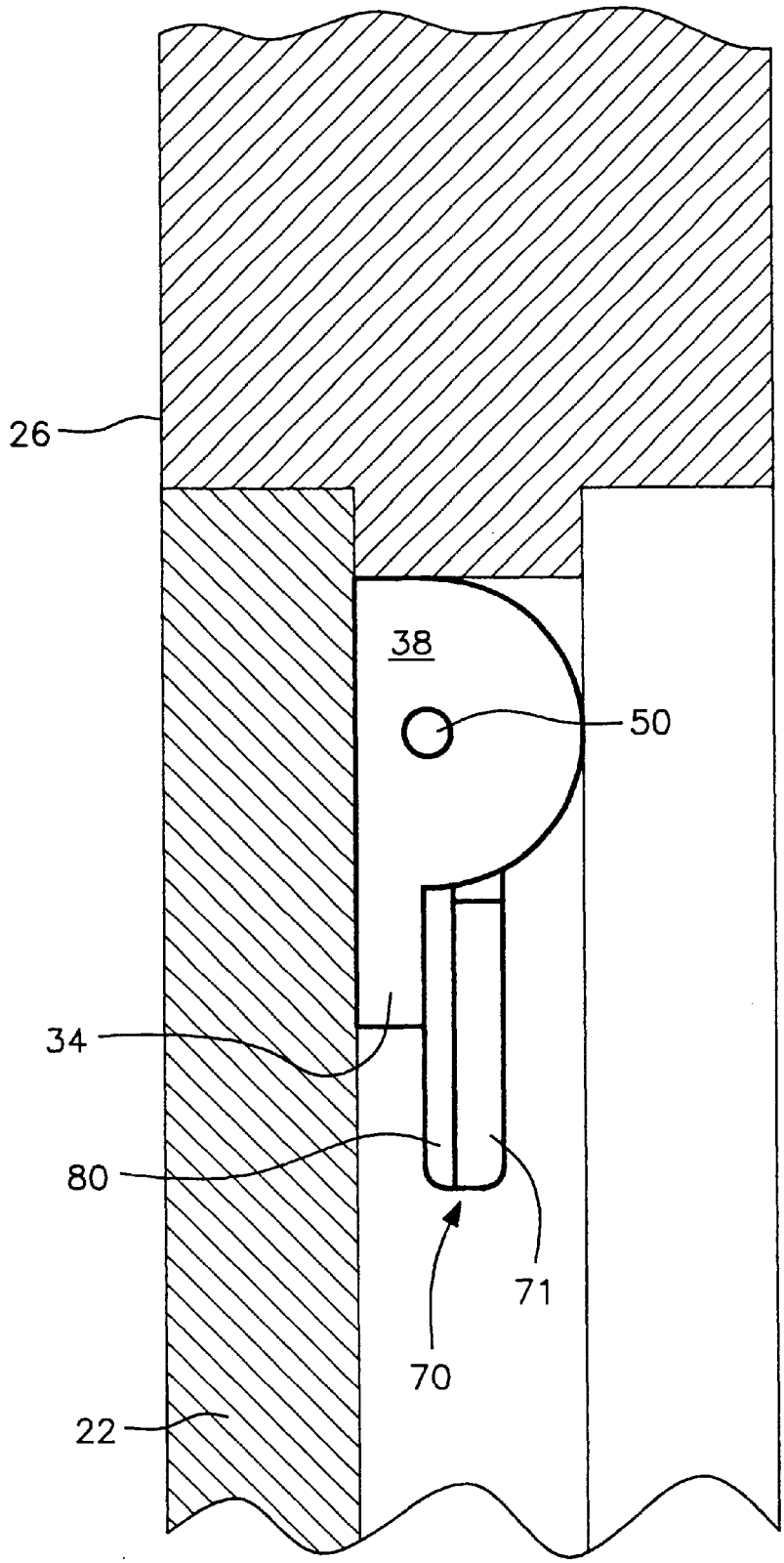
FIG. 2 is a sectional view taken along line 2—2 of FIG. 1 illustrating the door in a closed condition and the preferred embodiment in an unarmed deactivated position.

The preferred embodiment of the invention, which is generally designated 20 in FIG. 1 as viewed from the interior of the building in which the invention is used is mounted on the inside surface of a conventional outside access door 22 which is hingedly mounted on the right side 24 of a conventional door frame which also includes a horizontal top frame component 26 and a left side member 28. A conventional door closure effecting apparatus 30 extends between the door and the horizontal top frame component 26 in well-known manner for urging the door towards its closed position which is shown in FIGS. 1 and 2. An emergency exit release device 32 is also provided on the door for actuation in a well-known manner in case of the need for an emergency or routine exit from the interior of the building.

When the door 22 is swung open by movement of the left side of the door away from the left side door frame member 28, the preferred embodiment 20 of the invention is manually actuated in a manner to be discussed so that the door is prevented from returning to the fully closed position of FIG. 1; however, the door is permitted to return to a holding position that is fairly close to the door frame but beyond which the door cannot move inwardly toward the fully closed position. A significant aspect of the invention is that when the door is subsequently moved outwardly beyond the holding position, such as when the user preparing to reenter the building, the closure prevention device 20 is deactivated or dearmed so that the door is subsequently permitted to be fully closed by the conventional door closure means 30 after the user enters the building without need for any further action by the user.

Figure 9:
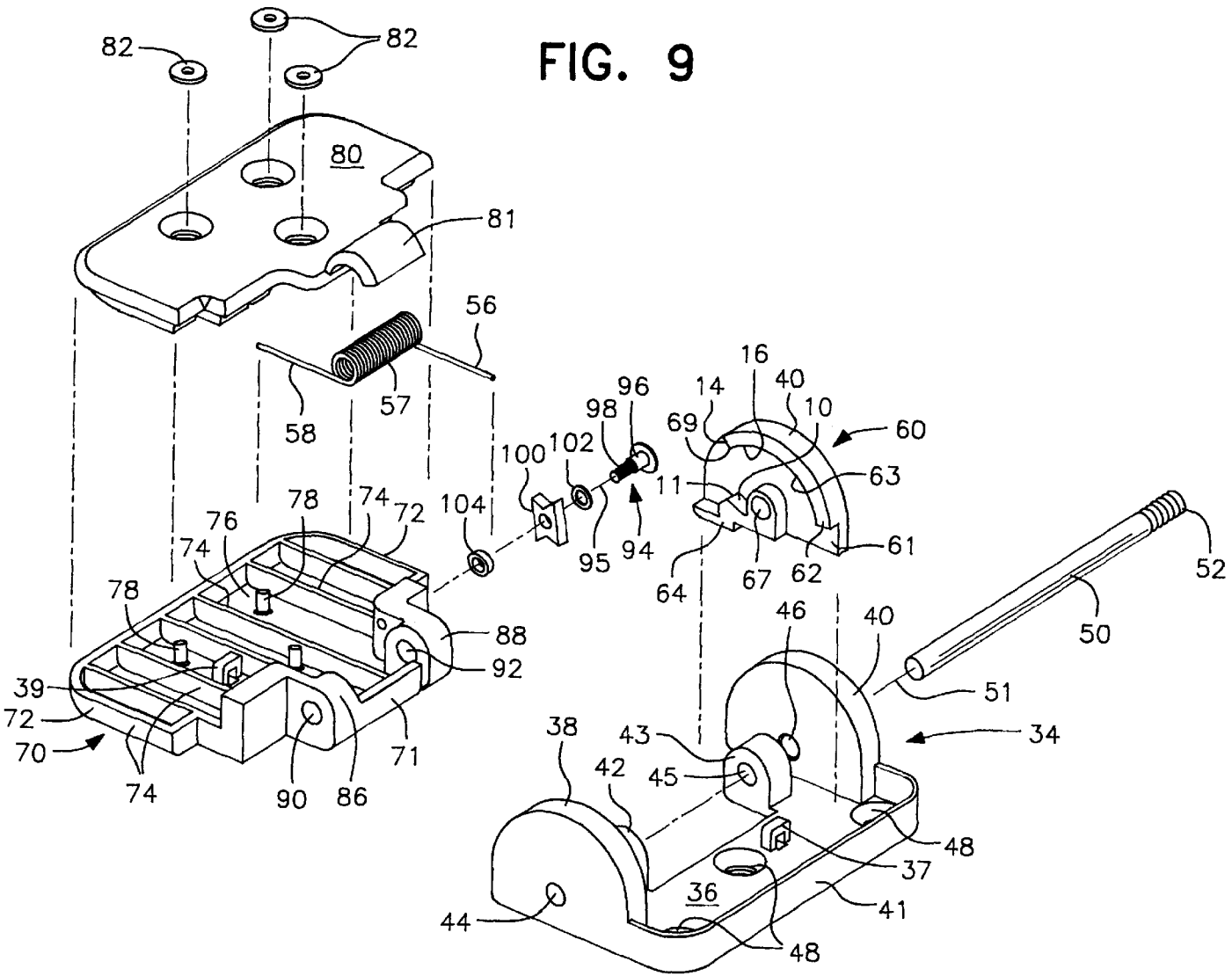
FIG. 9 is an exploded perspective view of the preferred embodiment of the invention.

Turning now to the specifics of the preferred embodiment, attention is initially invited to FIG. 9 of the drawings which illustrates the structure of the preferred embodiment in detail. Specifically, a mounting base 34 of un-shaped configuration and formed of stainless steel or other heavy strong metal includes a foot plate 36 from opposite ends of which a first end shoulder 38 and a second end shoulder 40 extend upwardly and are connected by a peripheral wall portion 41. Additionally, a first pin supporting shoulder 42 extends unitarily from first end shoulder 38 and a second pin supporting shoulder 43 extends upwardly from foot plate 36 adjacent to, but spaced from, second end shoulder 40. A pin receiving bore 44 extends through first end shoulder 38 and first pin supporting shoulder 42 and is axially aligned with a pin receiving bore 45 in pin supporting shoulder 43 and an end bore 46 in second end shoulder 40. Foot plate 36 additionally includes three countersunk openings 48 for receiving mounting screws for attaching mounting base 34 to hingedly mounted door 22 in the manner shown in FIG. 1.

Figure 3:
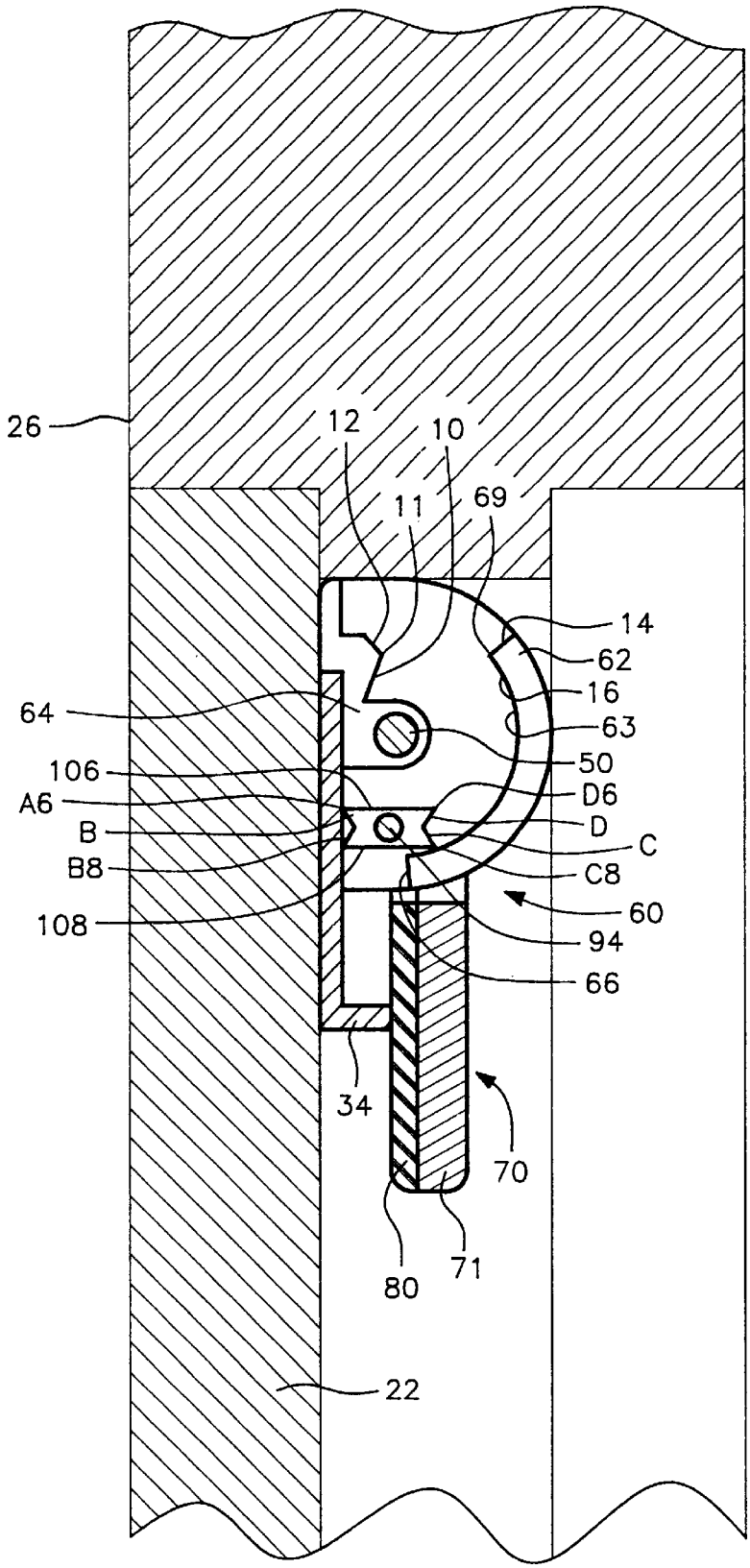
FIG. 3 is a section view taken along line 3—3 of FIG. 1 illustrating the door in a closed condition in which the preferred embodiment is in its unarmed deactivated position with the rotary latch being in a first or transit position.

Mounting base 34 also provides support for a latch control guide generally designated 60 which includes an end plate 61 along the outer edge periphery of which an arcuate latch guide and control rib 62 having an arcuate inner surface 63 extends as best shown in FIGS. 3 and 9. Latch positioning cam or a latch control block 64 is uniformly formed with end plate 61. Latch control block 64, support or end plate 61 and latch guide rib 62 are a unitary structure. It should be noted that control block 64 also includes a first latch positioning cam surface 10 and a second latch positioning cam surface 12 (FIG. 3) which intersect along comer line 11 as shown in FIG. 3. A third latch positioning cam surface 14 and a fourth latch sequential positioning cam surface 16 at the end of arcuate surface 63 are provided on latch guide and control rib 62 and act to control positioning of a rotary latch 100.

A pin receiving bore 67 extends through end plate 61 and latch control block 64 in axial alignment with bores 44, 45 and 46 for receiving a pivot shaft 50 having an axis 51 and a knurled end surface 52. Pivot shaft 50 extends through all four bores 44, 45, 46 and 67 and has its knurled end surface 52 jammed and frictionally retained in bore 46. Pivot shaft 50 provides pivotal support for a pivotable stop 70. Rotary latch 100 is supported on a latch supporting pin 94 mounted in the right end of pivotable stop 70 for sequential rotary positioning by cam surfaces 10, 12, 14 and 16 during each cycle of operation as discussed hereinafter.

An upwardly extending spring end retaining lug 37 extends upwardly from foot plate 36 and receives end 56 of torsion spring 57. the body of torsion spring 57 is mounted on pivot shaft 50 and has a second end 58 received in a similar lug 39 on pivotable stop 70 so that torsion spring 57 always provides a braising force on pivotable stop 70 tending to rotate pivotable stop 70 in a clockwise direction about pivot shaft 50 as viewed in FIGS. 2 through 8.

Pivotable stop 70 comprises a shell-like ridged metal body 71 having a peripheral wall 72 and a plurality of transverse rib plates 74 extending upwardly from a floor plate 76. Additionally, cylindrical studs 78 and spring end retaining lug 39 also extend upwardly from base plate 76. A urethane foam pad 80 is attached to pivotable stop 70 by conventional spring-lock retainer means 82 which are received in counter sunk recesses 84 in which the upper ends of mounting studs 78 extend. Foam pad 80 includes an arcuate spring cover extension 81 which covers the body of spring 57.

Pivotable stop 70 additionally has first and second pivot bearing lugs 86 and 88 having aligned bores 90 and 92 through which pivot shaft 50 extends. Pivotal stop 70 is consequently mounted for pivotable involvement between a closed deactivated position shown in FIGS. 1 and 2 and a fully extended position shown in FIGS. 4 and 6.

Figure 11:
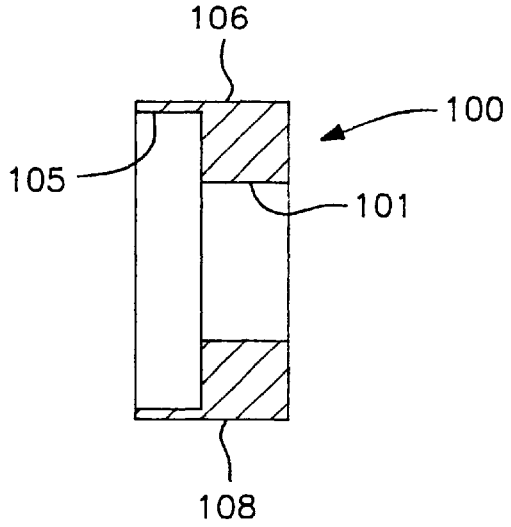
FIG. 11 is a sectional view of the rotary latch taken along line 11—11 of FIG. 10.
Figure 12:
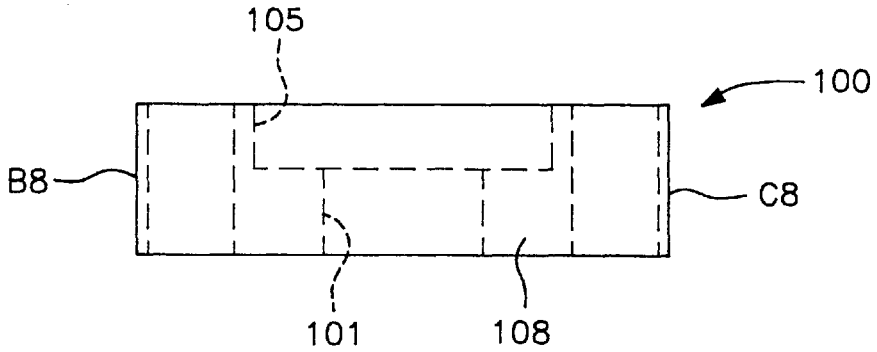
FIG. 12 is a bottom elevation view of the rotary latch.

The rotary latch support pin 94 has an axis 95 with a smooth bearing surface 96 (FIG. 9) and a knurled outer end portion 98 which is frictionally jammed and retained in a bore in the right end of pivotal stop 70. Pin 94 extends through a small diameter bore 101 and a large diameter bore 105 (FIGS. 10, 11 and 12) of rotary latch 100 which is supported for rotation on smooth bearing surface 96 of pin 94 which is positioned in small diameter bore 101 of rotary latch 100. A low friction washer 102 and a thrust washer 104 maintain the rotary latch in alignment with inwardly facing latch positioning cam surface 16 of latch guide rib 62 while permitting rotary latch 100 to remain rotatable to multiple operative positions on pin 94.

Figure 10:
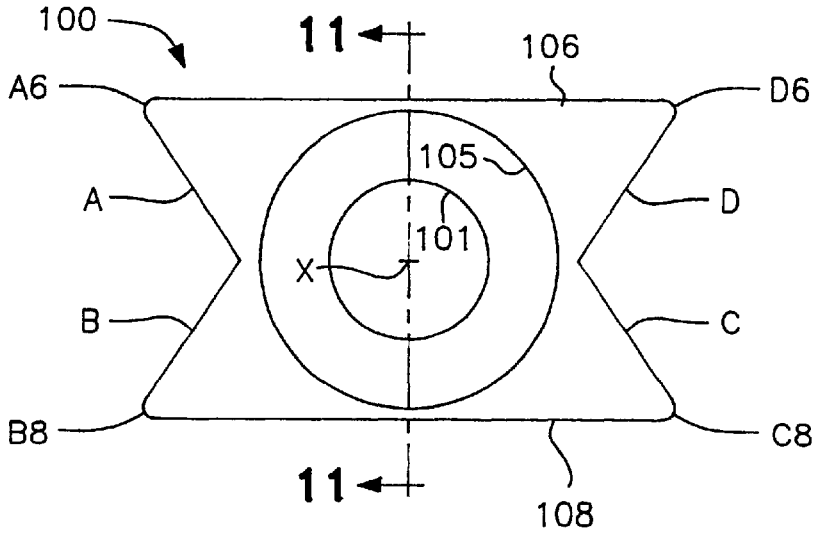
FIG. 10 is a front elevation view of rotary latch means employed in the preferred embodiment.

The rotary latch 100 is a generally rectangular metal plate having parallel planar side surfaces 106 and 108 which are connected at their end portions by first and second v-shaped surfaces as best shown in FIG. 10. The first v-shaped surface is defined by planar end surfaces A and B and the second v-shaped end surface is defined by planar end surfaces C and D. It should be noted that the intersection of the planar end surfaces A and B with each other is in alignment with the common axis of small diameter bore 101 and larger diameter bore 105 of latch 100 and the same is true with respect to the intersection of planar end surfaces C and D. Also, the intersection of the planar end surfaces with the side surfaces is defined by rounded comers A6, D6, C8 and B8 as shown in FIG. 10.

A cycle of operation of the preferred embodiment begins with the components in the positions illustrated in FIGS. 1, 2 and 3 in which door 22 is closed and pivotal stop 70 is in its unarmed deactivated position fully within the confines of the door periphery. Also, the rotary latch 100 is in a first or transit position relative to pivotal stop 70.

Figure 4:
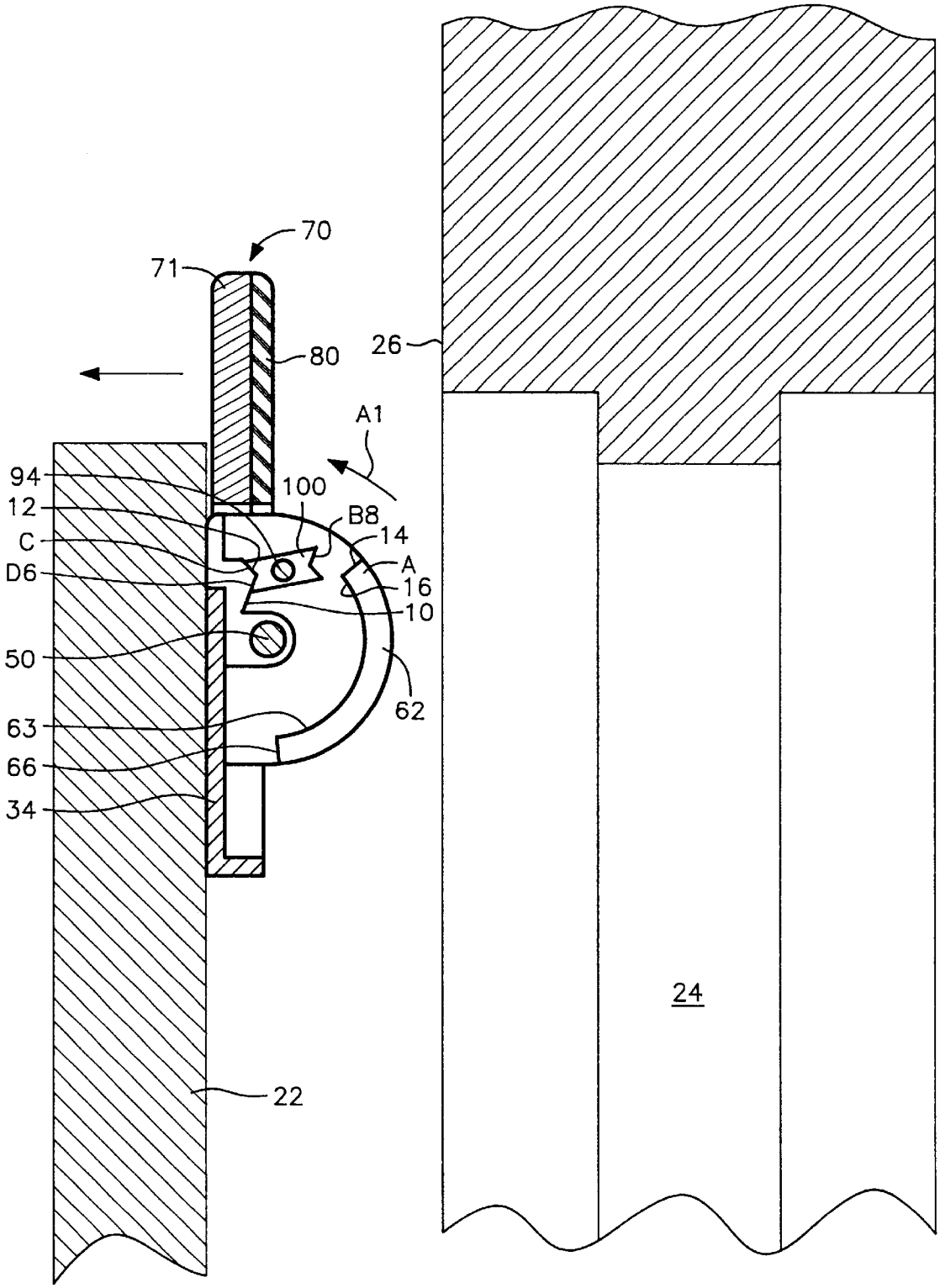
FIG. 4 is a sectional view taken along line 3—3 of FIG. 1 but illustrating the parts in a position subsequent to the FIG. 3 position with the door in an open position, the pivotable stop in a fully extended position and the rotary latch in a second or latch ready position.

The user initially engages the emergency exit release device 32 and opens the door and promptly manually engages pivotal stop 70 and rotates it upwardly in a counterclockwise direction about pivot shaft 50 from its FIG. 3 unarmed deactivated position to its fully extended position shown in FIG. 4. During the foregoing movement rotary latch 100 remains in the FIG. 3 first or transit position relative to pivotal stop 70 until the pivotal stop moves into its fully extended position at which time rounded comer D6 concurrently contacts the first latch positioning cam surface 10 and rotary latch 100 is rotated into a second or latch ready cocked position illustrated in FIG. 4. Latch 100 is precluded from rotation beyond the desired position shown in FIG. 4 by contact of latch end surface C with second latch positioning cam surface 12. The second or latch ready position of rotary latch 100 which is shown in FIG. 4 is transient position necessary in order for rotary latch 100 to be subsequently moved into a third or latching position at the completion of the next movement of pivotable stop 70 to the intermediate holding position illustrated in FIG. 5.

Figure 5:
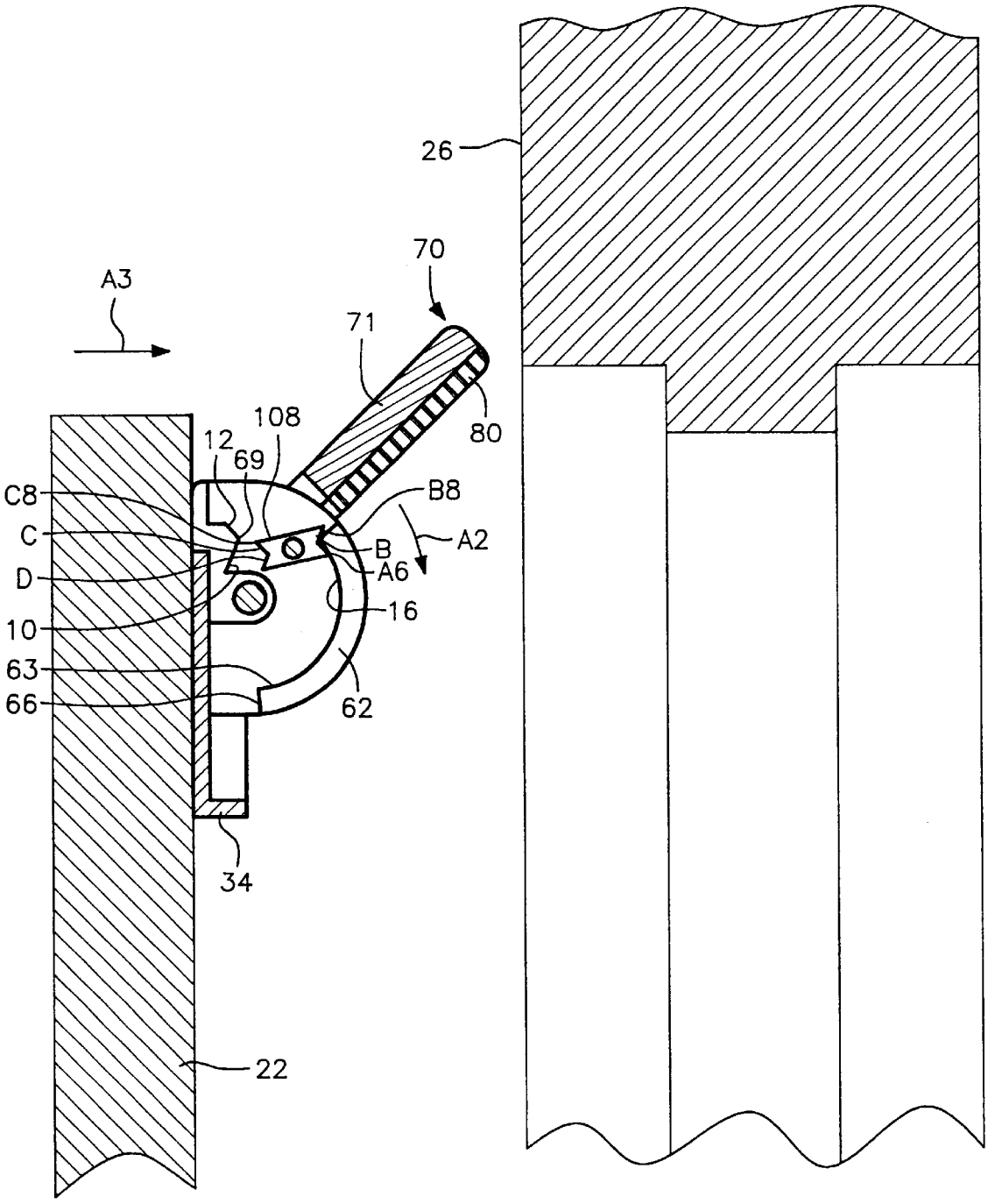
FIG. 5 is a sectional view taken along line 3—3 of FIG. 1 in a position subsequent to the FIG. 4 position with the door in a subsequent open position to that of FIG. 4 and the pivotable stop in an armed intermediate holding position assumed in response to manual release of the pivotable stop from the FIG. 4 position and with the rotary latch being in a third or latching position.

More specifically, movement of pivotable stop 70 from its fully extended position of FIG. 4 to its intermediate holding position of FIG. 5 is immediately initiated by the user's release of pivotable stop 70 promptly upon its arrival at its FIG. 4 position which release permits torsion spring 57 to rotate pivotable stop 70 in the clockwise direction of arrow A2 as shown in FIG. 5. Such rotation of pivotable stop 70 from its FIG. 4 position in the direction of arrow A2 results in end surface D of rotary latch 100 initially coming into contact with third latch positioning cam surface 14 and comer edge 69 which rotates pivotable latch 100 counterclockwise about latch supporting pin 94 into the third or latching position shown in FIG. 5. The foregoing rotation is terminated by engagement of comer A6 of latch 100 with the inwardly facing fourth latch positioning cam surface 63 of latch guide rib 62 so that movement of the pivotable stop in direction A2 is immediately terminated.

The user subsequently releases the door and consequent movement of the door in the closing direction shown by arrow A3 (FIG. 5) caused by operation of the door closure apparatus 30 results in contact of the urethane foam cushion 80 of pivotable stop 70 with the surface of horizontal top frame component 26 of the door frame which causes pivotable stop 70 to be pivoted counterclockwise back towards its fully extended open position shown in FIG. 6. Full closure of the door is consequently prevented and the door is maintained in its unclosed holding position of FIG. 6 awaiting return of the user.

Figure 6:
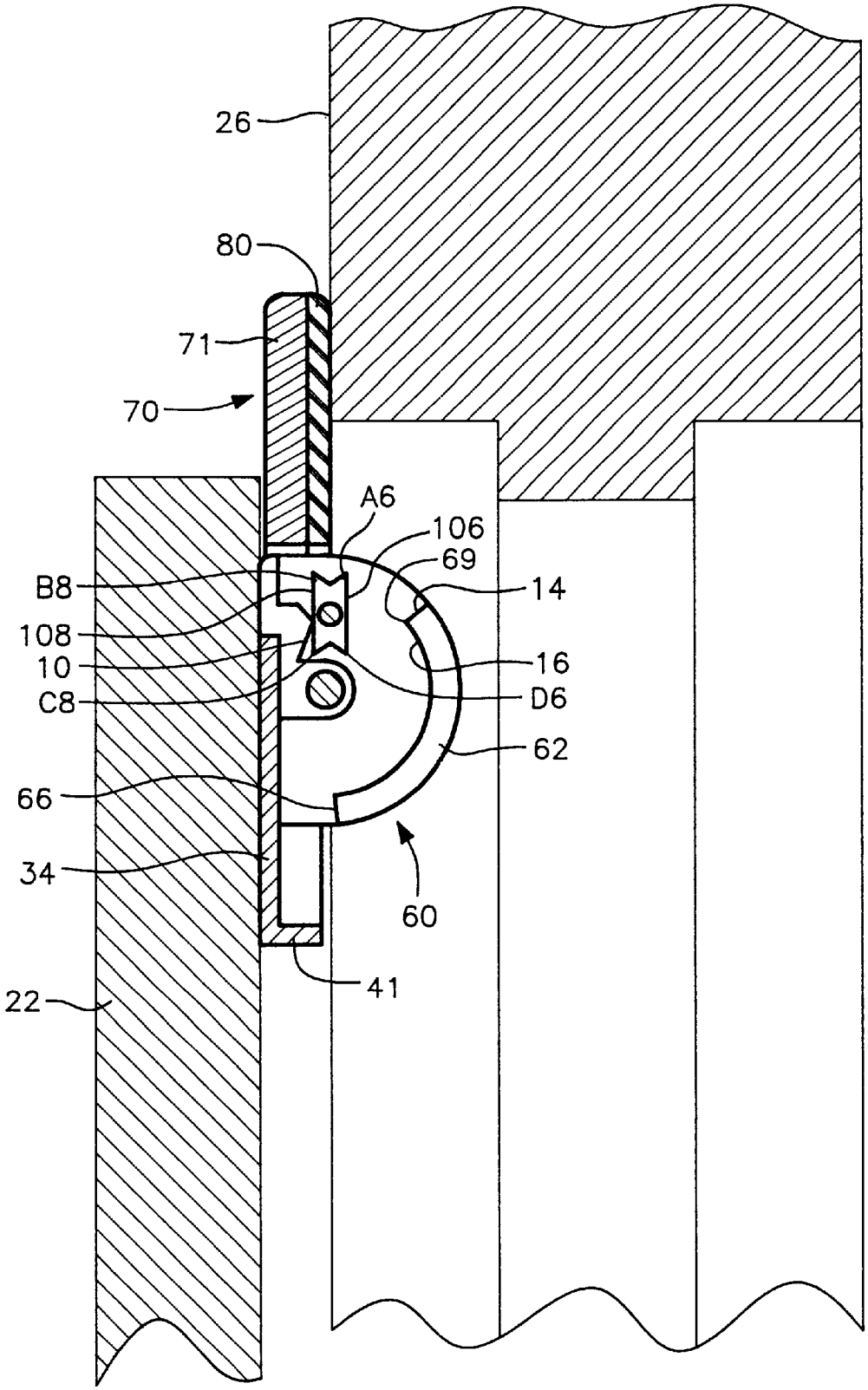
FIG. 6 is a sectional view taken along line 3—3 of FIG. 1 illustrating the position of the components assumed subsequent to the FIG. 5 position in response to movement of the door toward its closed position by conventional door closing means with the rotary latch being in a fourth or return position.

Return of stop 70 from its FIG. 5 position to its FIG. 6 fully extended open position also results in repositioning counterclockwise movement of rotary latch 100 into a fourth or return enabling position due to contact of corner C8 and with first latch positioning cam surface 10 and subsequent contact of surface 108 with corner edge 11 which rotates rotary latch 100 in to the fourth or return enabling position shown in FIG. 6.

Figure 7:
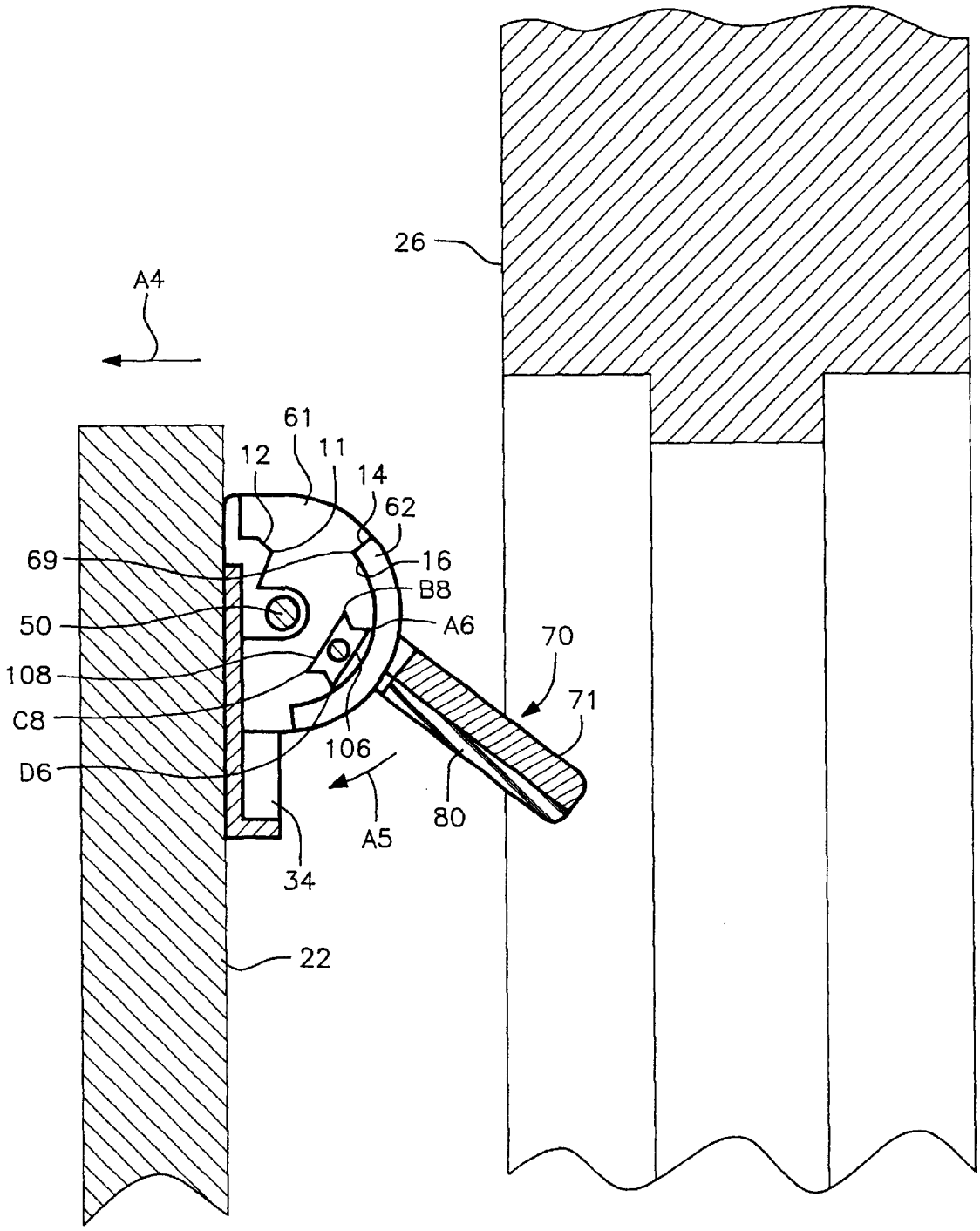
FIG. 7 is a sectional view taken along line 3—3 of FIG. 1 but illustrating the parts in a subsequent position to the position of FIG. 6 resultant from manual opening of the door from the FIG. 6 position.
Figure 8:
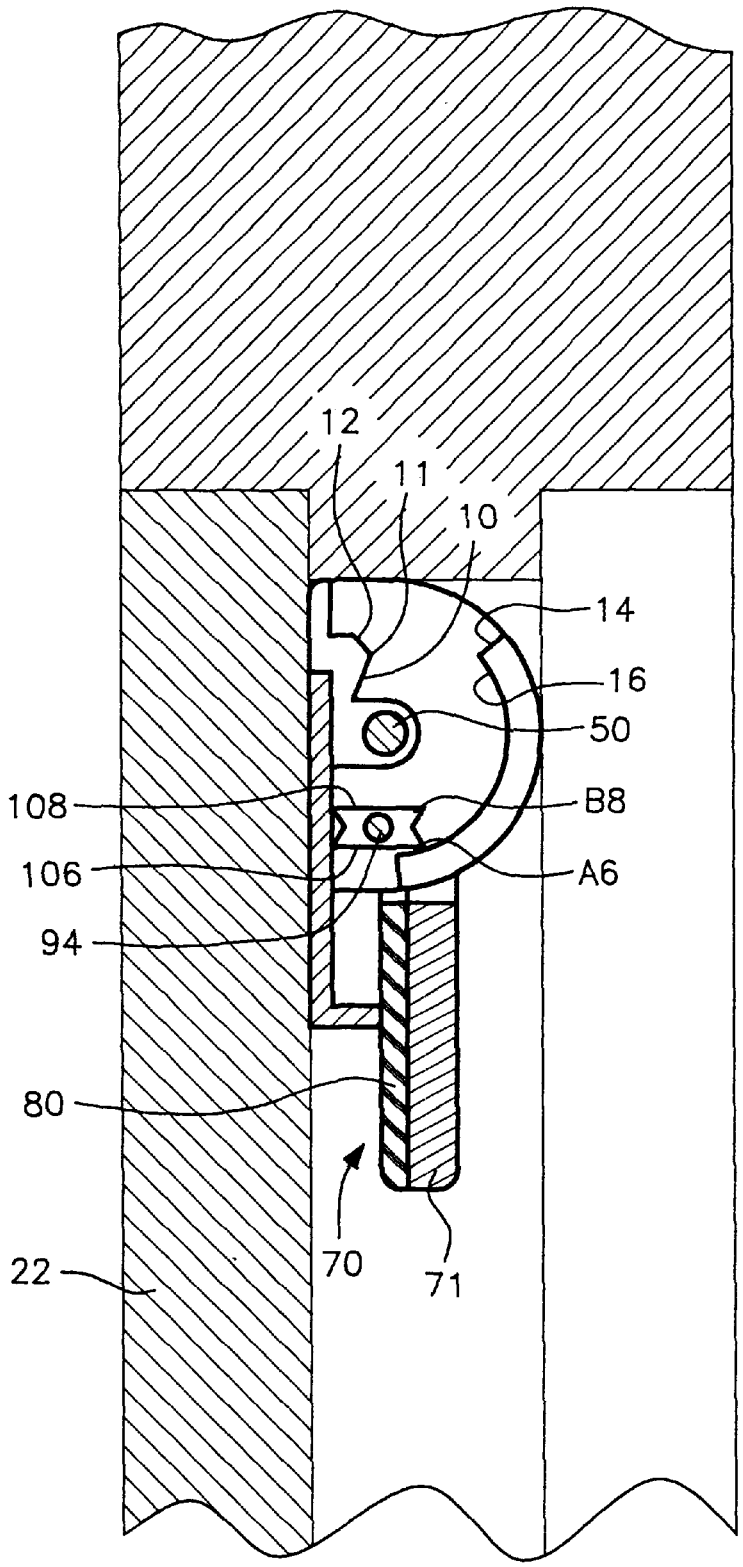
FIG. 8 is a sectional view taken along line 3—3 of FIG. 1 illustrating the parts in a position subsequent to the position of FIG. 7 and which is the last position assumed during a cycle of operation.

The final step in the cycle of operation is effected by the user's return and initiation of opening movement of door 22 from its FIG. 6 unclosed holding position towards its open position in the direction of arrow A4 in FIG. 7. Such action causes the pivotable stop 70 to clear the surface of the horizontal top frame component 26 so that the torsion spring 57 immediately rotates the pivotable stop 70 about pivot shaft 50 in a clockwise direction shown by arrow A5 in FIG. 7. The initial movement of the pivotable stop from its FIG. 7 towards its FIG. 8 position causes surface 106 of rotary latch 100 to engage corner edge 69 of latch guide rib 62 which causes rotary latch 100 to rotate in a counterclockwise direction on pin 94 into a fifth or return home position which it retains as the pivotable stop returns to the FIG. 8 position. It should be noted that the only difference between the FIG. 3 position and the FIG. 8 position is that rotary latch 100 has been rotated one hundred and eighty degrees (180°). Thus, rotary latch 100 has in effect been returned to a mirror image of its FIG. 3 first position. Naturally, completion of the next door cycle of operation will return the rotary latch 100 to the precise FIG. 3 position.

It should be understood that the present application describes the preferred embodiment of the invention but that the scope of the invention is not limited to the present disclosure but is defined solely by the appended claims. Numerous modification of the invention will undoubtedly occur with skill in the art but it should be understood that such modifications do not necessarily avoid the coverage provided by the appended claims.

What is claimed is:

1. A door closure prevention device mountable on a moveable door positioned for movement between an open position and a closed position relative to a fixed door frame for selectively preventing movement of the door from an open position to a closed position while being easily deactivated to permit return of the door to its closed position, said door closure prevention device comprising:

(a) a mounting base including connection permitting means permitting attachment of said mounting base to a movable door having a periphery hingedly moveable relative to an adjacent fixedly positioned door frame structure between an open position in which the periphery of the door is largely external of said fixedly positioned door frame structure and a closed position in which said periphery of the door is positioned within said fixedly positioned door frame structure;

(b) a pivotable stop mounted on said mounting base for pivotal movement about a stop pivot axis in an opening direction from an unarmed deactivated position in which said pivotal stop is positioned within the periphery of the door to permit the door to be filly closed and a filly extended position in which said pivotable stop extends beyond the door frame so as to be capable of engaging a portion of the fixed door frame to preclude fill closure of the door and wherein said pivotable stop is also rotationally positionable in an armed intermediate holding position between said unarmed deactivated position and the filly extended position, said pivotable stop also being extended beyond the periphery of the door when in said intermediate holding position;

(c) rotary latch means positioned on and rotationally positionable relative to said pivotable stop in a first or transit position during movement of said pivotable stop from said unarmed deactivated position to said fully extended position, a second or latch ready cocked position for movement of said pivotable stop from said fully extended position to said intermediate holding position, a third or latching position for precluding movement of said pivotal stop from the intermediate holding position toward the unarmed deactivated closed position, a fourth or return enable position assumed in response to movement of said pivotal stop from the intermediate holding position to the fully extended open position and a fifth or return home position assumed for permitting movement of said pivotal stop from the intermediate holding position to the unarmed deactivated closed position; and (d) positioning means responsive to pivotal movement of said stop and a door opening movement followed by a partial door closure and a second door opening movement for sequentially positioning said rotary latch means in said first position, said second position, said third position, said fourth position and said fifth position.

2. A door closure prevention device as recited in claim 1, wherein said rotary latch means is mounted for rotation about a latch supporting pin having a supporting pin axis and which is mounted on said pivotable stop for pivotal movement about said stop pivot axis.

3. A door closure prevention device as recited in claim 2, wherein said rotary latch means is sequentially rotated on the latch supporting pin by said positioning means in a counter-clockwise direction for movement from said first position to said second position, from said second position to said third position, from said third position to said fourth position and from said fourth position to said fifth position.

4. A door closure prevention device as recited in claim 3, wherein said rotary latch means has a latch axis about which it is concentric and about which it is rotatable on said supporting pin axis.

5. A door closure prevention device as recited in claim 4, wherein said latch axis is mounted to move in an arcuate path about said stop pivot axis.

6. A door closure prevention device as recited in claim 5, wherein said positioning means includes first and second latch positioning cam surface engageable with said rotary latch for positioning said rotary latch in said second or latch ready cocked position, third and fourth latch positioning cam surface for positioning said rotary latch in said third or latching positioning.

7. A door closure prevention device as recited in claim 6, wherein said rotary latch means is an elongated plate having first and second side surfaces and first and second V-shaped end surfaces at opposite ends extending inwardly.

8. A door closure prevention device as recited in claim 7, wherein said elongated plate is of general rectangular configuration and is concentric with respect to an axis of rotation about which it rotates.

9. A door closure prevention device as recited in claim 8, wherein said elongated plate has a longitudinal axis extending through said axis of rotation and about which the periphery of said plate is concentric.

10. A door closure prevention device as recited in claim 9, wherein said V-shaped end surfaces are two rectangular surfaces intersecting at said longitudinal axis.

11. A door closure prevention device as recited in claim 10, wherein said stop pivot axis is perpendicular with respect to a vertical door hinge axis of said door.

12. A door closure prevention device as recited in claim 1, additionally including spring means urging said pivotal stop toward said unarmed deactivated position.

13. A door closure prevention device as recited in claim 12, wherein said rotary latch means is mounted for rotation about the axis of a latch supporting pin which is mounted on said pivotable stop for pivotal movement about said stop pivot shaft.

14. A door closure prevention device as recited in claim 13, wherein said latch means is an elongated plate having V-shaped end surfaces at opposite ends extending inwardly from each end between parallel side surfaces.

15. A door closure prevention device comprising:

(a) a base means;

(b) a pivotal stop mounted for forward or rearward pivotal movement on said base between a first or deactivated stop position and a second or extended activated stop position;

(c) spring means urging said pivotal stop toward its deactivated position;

(d) rotary latch means supported on said pivotal stop for rotational movement into plural rotary latch positions relative to said pivotal stop;

(e) first, second, third and fourth cam surfaces on said base;

(f) said first cam surface being positioned to engage said rotary latch means concurrently with forward movement of said pivotal stop from said first or deactivated stop position into said second or extended stop position to effect positioning of said rotary latch means in a second latch position from a first latch position relative to said pivotal stop;

(g) said third and fourth cam surfaces being positioned to engage said rotary latch means in response to movement of said pivotal stop from said second or extended activated stop position to a third or intermediate partially extended stop position located between said first or deactivated stop position and said second or extended stop position for repositioning said rotary latch means from said second latch position into a third latch position in which said rotary latch precludes further movement of said pivotal stop toward said first or deactivated stop position;

(h) wherein rearward movement of said pivotal stop from said third or intermediate partially extending position back to said second or extended activated stop position effects contact of said rotary latch means with said first cam surface which moves said rotary latch means from its third position to a fourth position in which said rotary latch means does not impede subsequent rearward movement of said pivotal stop from said second or extended activated stop position through said intermediate partially extended stop position but brings said rotary latch means into contact with said third cam surface which moves said rotary latch means from said fourth latch position to a fifth latch position in which said latch means remains as said pivotal stop returns to its first or deactivated stop position.

16. A door closure prevention device as recited in claim 15, wherein said rotary latch means is supported for rotation on a latch supporting pin extending from said pivotal stop.

17. A door closure device prevention device as recited in claim 15 additionally including a pivot shaft attached to said base means and supporting said pivotal stop and wherein said first, second, third and fourth cam surfaces are provided on latch control guide means held in a fixed position on said base means by said pivot shaft.

18. A method of controlling a pivotable door closure preventing stop mounted for pivotable movement on a door that mounted in a door frame and is biased toward a closed position by a door closure effecting device, said method comprising the steps of:

(a) providing a continuous biasing force on said stop tending to position said stop in an unarmed deactivated position within the periphery of the door;

(b) opening the door and manually pivoting said stop in an opening direction against said biasing force to an extended position in which said stop extends beyond the periphery of the door;

(c) permitting said biasing force to return said stop in a closing direction to an armed intermediate position between said extended position and said unarmed deactivated in which the stop remains in an extended position beyond the periphery of the door;

(d) positioning a latch in a latching position in response to steps (b) and (c) to prevent said stop from moving in a closing direction beyond said armed intermediate position;

(e) permitting said door to move in a closing direction so that said stop engages the door frame to both prevent full door closure and to pivot said stop in said opening direction to said fully extended position in which said stop prevents further closing movement of the door; and (f) repositioning said latch from said latching position in response to step (e) so that subsequent opening movement of the door permits said biasing force to return the stop to said closed position so as to permit the door to close completely.

19. The method of claim 18, wherein the positioning of said latch as recited in (d) and (f) is effected by bodily moving said latch concurrently with the movement of said stop into contact with plural cam surfaces which first engage the latch and rotate the latch firstly into said latching position as recited in (d) and subsequently move the latch from said latching position as recited in (f).

20. The method of claim 19, wherein the bodily movement of said latch is effected by pivotal movement about a pivot axis about which said stop also pivots.

* * * * *